US005186815A

United States Patent [19]

Lenglet

[11] Patent Number: 5,186,815

[45] Date of Patent: Feb. 16, 1993

[54] METHOD OF DECOKING AN INSTALLATION FOR STEAM CRACKING HYDROCARBONS, AND A CORRESPONDING STEAM-CRACKING INSTALLATION

[75] Inventor: Eric Lenglet, Marly le Roi, France

[73] Assignee: Procedes Petroliers et Petrochimiques, Marly le Roi, France; a part interest

[21] Appl. No.: 623,730

[22] PCT Filed: Apr. 13, 1990

[86] PCT No.: PCT/FR90/00272

§ 371 Date: Dec. 12, 1990

§ 102(e) Date: Dec. 12, 1990

[87] PCT Pub. No.: WO90/12851

PCT Pub. Date: Nov. 1, 1990

[30] Foreign Application Priority Data

| | | | |
|---|---|---|---|
| Apr. 14, 1989 | [FR] | France | 89 04986 |
| Jul. 12, 1989 | [FR] | France | 89 09373 |
| Jul. 12, 1989 | [FR] | France | 89 09375 |
| Oct. 6, 1989 | [FR] | France | 89 13070 |
| Oct. 27, 1989 | [FR] | France | 89 14118 |

[51] Int. Cl.[5] ..... C10G 9/12; C10G 9/16

[52] U.S. Cl. ..... 208/48 R; 585/652; 585/950; 134/8; 208/48 Q; 208/48 AA

[58] Field of Search ..... 208/48 R, 130; 134/8; 585/950, 652

[56] References Cited

U.S. PATENT DOCUMENTS

| | | | |
|---|---|---|---|
| 1,939,112 | 12/1933 | Eulberg | 196/69 |
| 2,735,806 | 2/1956 | Molstedt et al. | 208/48 R |
| 3,090,746 | 5/1963 | Markert | 208/48 R |
| 3,365,387 | 1/1968 | Cahn et al. | 208/48 R |
| 3,592,762 | 7/1971 | Blaser et al. | 208/48 R |
| 3,641,190 | 2/1972 | Kivlen et al. | 208/48 R |
| 4,046,670 | 9/1977 | Seguchi et al. . | |
| 4,203,778 | 5/1980 | Nunciato et al. | 134/8 |
| 4,297,147 | 10/1981 | Nunciato et al. . | |

*Primary Examiner*—Helane Myers

*Attorney, Agent, or Firm*—Bell, Seltzer, Park & Gibson

[57] ABSTRACT

A method of decoking the inside walls of a hydrocarbon steam-cracking installation by means of solid particles of very small size, which particles are injected into the hydrocarbon feedstock flowing through tubes (12) of the steam-cracking furnace (10) and through indirect quench means (16). A cyclone (28) at the outlet from said indirect-quench means serving to separate the solid particles from the gaseous products and enabling the solid particles to be recycled through the installation after being mixed with a liquid or a gas and after their pressure has been raised. The invention also relates to a steam-cracking installation enabling the method to be performed.

11 Claims, 8 Drawing Sheets

METHOD OF DECOKING AN INSTALLATION FOR STEAM CRACKING HYDROCARBONS, AND A CORRESPONDING STEAM-CRACKING INSTALLATION

The invention relates to a method of decoking an installation for steam cracking hydrocarbons, and to steamcracking installations including means for implementing the method.

In order to remove the coke deposited on the inside walls of an installation for steam cracking hydrocarbons and comprising a steam-craking furnace generally followed by indirect-quench boiler for cooling the cracked gas, it is common practice to use a chemical decoking method based on oxidization by an air-steam mixture. To do this, it is necessary to interrupt operation of the steam-cracking installation and to isolate it from equipment situated downstream.

As an oxidizing agent, it is also possible to use steam superheated to high temperature, together with an optional addition of hydrogen. There is then no need to isolate the steam-cracking installation, but it is still necessary to interrupt its operation. In addition, decoking takes place more slowly than in the preceding method.

These two prior methods are not suitable for completely decoking the indirect-quench boiler situated at the outlet from the steam-cracking furnace. For this purpose, it is necessary from time to time to close down the installation completely, and to decoke the quench boiler by hydraulic means (water jets under very high pressure) capable of breaking up the layer of coke. A hydraulic sand blasting method is also used, with relatively large particles of sand being injected together with water under pressure in order to assist in breaking up the layer of coke, or else mechanical means may be used.

A method has also been proposed for decoking a steam-cracking installation having a single pass type furnace comprising small-diameter rectilinear tubes each extended by an individual quench heat exchanger. The method consists in chemically decoking the inside walls of the furnace tubes by means of steam, thereby causing a portion of the coke to detach from the inside walls in the form of flakes or scale which then breaks up the coke deposited downstream therefrom on the walls of the heat exchangers. This method thus simultaneously decokes the furnace and the indirect-quench means. However, it is still necessary to interrupt the operation of the steam cracking installation.

Finally, various methods have been proposed which consist essentially in injecting solid particles into the installation. A first method consists in setting up a flow of inert gas conveying metal particles of relatively large size (250 μm to 2500 μm) through a furnace connected to the atmosphere. Another method proposes using continuous sand blasting in the steam-cracking installation by injecting sand into the liquid hydrocarbon feedstock. The sand particles (standard sand particles having a mean diameter of 200 μm–1000 μm) pass through the furnace and the indirect-quench boiler and they are finally trapped by the direct-quench heavy oil. The drawbacks of this last-described method are such that it has not been possible to use it: unless a very complex and expensive system is installed for fractioning and washing particles, it is more or less impossible to separate the particles of sand from the direct-quench heavy oil without entraining the difficult-to-vaporize heavy tar contained therein, and as a result, in practice, the particles of sand are not suitable for recycling and the quench oil becomes unusable, even as a fuel; continuously sand blasting the installation also gives rise to severe, or even catastrophic erosion of the tubes through which the feedstock and the products of steam-cracking flow; and finally, injecting particles of sand into the liquid feedstock runs a major risk of solid deposits building up in the zone at the end of hydrocarbon feedstock vaporization.

The object of the invention is to provide a method of decoking a hydrocarbon steam-cracking installation which avoids the drawbacks of prior methods.

Another object of the invention is to provide a method of this type making it possible to decoke the furnace and possibly also the indirect-quench boiler of the installation without it being necessary to take the installation out of operation, without running any risk of damaging the installation itself, and without polluting the downstream portions of the installation with solid particles.

To this end, the present invention provides a method of decoking a hydrocarbon steam-cracking installation, the method consisting in eliminating by erosion at least a portion of the coke deposited on the inside walls of the installation, in particular inside a steam-cracking furnace and inside an indirect-quench boiler, the erosion being by means of solid particles conveyed by a high speed flow of a vector gas, the method being characterized in that the decoking is performed while the installation is in operation, the vector gas being constituted, at least in part, by the hydrocarbon feedstock mixed with steam, the vector gas containing solid particles having a mean diameter of less than about 150 μm, with a very low ratio of solids to gas, such that the mixture of vector gas and solid particles behaves as a gas having the capacity to perform light erosion.

Instead of breaking up the layer of coke deposited on the inside walls of the installation by violent shocks from massive particles, the method of the present invention thus makes it possible to erode them gently and regularly without any risk to the walls of the installation.

This method makes it possible to decoke both the steam-cracking furnace and the indirect-quench boiler simultaneously: for example, the quantity of solid particles conveyed by the flow of gas at the inlet to the indirect-quench boiler may be increased in order to compensate for the lower speed at which the gas flows through this boiler. It is also possible to decoke the convection zone, in particular at the dry point, by sequentially injecting the above-mentioned particles fed in with the dilution steam.

In the context of the present invention, the term "decoking" is used to mean effective removal of at least a portion of the coke deposited on the walls (reducing or eliminating a layer of coke that has already formed, or halting or reducing the rate at which a layer of coke builds up).

According to another characteristic of the invention, the mixture of vector gas and solid particles is cooled at the outlet from the steam-cracking furnace to an intermediate temperature less than about 600° C., said temperature being chosen to prevent any liquid condensing, at least a major portion of the solid particles then being separated from the vector gas in at least one cyclone, the pressure of at least a portion of the solid particles separated from the gas in the cyclone then being raised, and the particles being recycled through the steam-cracking installation.

Under good conditions, the efficiency of a cyclone or of two cyclones connected in series reaches or exceeds 95% or even 99%, which means that the gaseous products leaving the cyclone are substantially free from solid particles. In addition, since the remaining particles are very small in size, they have substantially no effect on the portions of the installation situated downstream from the cyclone.

In addition, since the cyclone for separating out the solid particles is not subjected to very high temperatures, it may be made of a low-alloy steel, i.e. a steel which is relatively cheap. The residual solid particles are trapped during the direct quenching by liquid injection to which the vector gas is subjected at the outlet from the cyclone. The cracked gases are thus completely particle-free before reaching the compression zone.

Finally, the limited cooling of the steam-cracked products at the outlet from the furnace causes a considerable reduction in chemical reaction rates and prevents any supercracking of the products in the cyclone.

The mean diameter of the solid particles used preferably lies in the range about 5 μm to about 100 μm, and the solid/gas ratio is less than 10% by weight, preferably lying in the range 0.01% to 10%, and generally lying in the range 0.1% to 8% by weight. The quantity of particles is sufficiently low to ensure that the particles hardly ever collide (no shocks); the mixture thus behaves like a gas and not like an entrained bed or a fluidized bed. The very fine particles spread essentially throughout the entire volume of the gas because of the predominance of turbulent forces. A gas is thus obtained containing fine particles throughout its volume, which particles are suitable for providing light erosion action by virtue of multiple low energy impacts, thereby wearing down the coke rather than breaking off large pieces (flakes). Particle speed in the furnace lies in the range 70 meters per second (m/s) to 480 m/s (and in general in the range 130 m/s to 480 m/s, and more particular in the range 130 m/s to 300 m/s). In the quench boiler, particle speeds lie in the range 40 m/s to 150 m/s.

The most appropriate quantity of particles depends on the nature of the particles, on the rate at which coke is deposited (which depends on the nature of the feedstock), and on local conditions of speed and turbulence.

Preferably, the mean size of the solid particles lies in the range 4 μm or 5 μm to 85 μm, and the solid/gas ratio lies in the range 0.1% to 8% by weight, e.g. in the range 0.1% to 3% by weight.

The solid particles used may be injected into the installation at various points, for example at one or more points in the steam-cracking furnace and at the inlet to the indirect-quench boiler.

Decoking can thus be adapted to the configuration of the steam-cracking furnace and decoking of the indirect-quench boiler can be optimized.

According to another characteristic of the invention, the solid particles separated from the vector gas in the cyclone are mixed with water or a hydrocarbon liquid substantially free from pyrolysis heavy aromatic compounds, e.g. a fraction of the hydrocarbon feedstock to be cracked, and the mixture of solid particles and liquid is recycled into the installation by pumping.

The flow rate and the temperature of the particle-liquid mixture may be chosen so as to obtain quasi-instantaneous vaporization of the liquid on injection of the mixture into the steam-cracking installation.

Advantageously, in order to put the above-mentioned liquid and the solid particles leaving the cyclone into contact with each other, the liquid is caused to flow continuously from a source line in order to form a wetted wall situated around and beneath the zone in which the solid particles arrive.

This avoids solid particles accumulating on the above-mentioned wall, and it also avoids the liquid forming droplets which could obstruct the solid-particle feed duct by causing solid particles to stick to a wet wall that is not swept by a continuous flow. In order to increase the particle-entraining and wall-cleaning effect, the liquid flow may be vortex fed (caused to rotate).

In a variant, the particles leaving the cyclone are collected in a tank, the tank is isolated and then put under pressure by means of a flow of superheated steam, and at least some of the particles are recycled through the installation by means of this flow of steam.

Advantageously, the solid particles used in the method of the invention are substantially spherical inorganic or metallic particles formed by gas spraying, such as porous particles based on silica or aluminum, and they may be constituted, for example, by particles of catalyst already used for catalytic cracking (zeolite), having a mean diameter of 60 μm to 80 μm.

The solid particles may alternatively be constituted by a mixture of two types of particle, one type being coke-catalyzing metal particles which are relatively soft under steam-cracking conditions, and the other type being harder and more erosive. Other particles (particles of coke, ground coal, cement, minerals, cast iron, steel, carbides, stellites, angular particles, . . . ) may also be used in the erosion gas conditions of the invention.

Relatively soft coke-catalyzing metal particles are liable to leave traces on bared metal portions of the inside walls of the installation, such that their catalytic effect causes protective layers of coke to cover said portions and protect them from excessive erosion.

According to another characteristic of the invention, the method also consists in allowing a layer of coke to form on the inside walls of the steam-cracking furnace and then in maintaining the thickness of this layer of coke around a predetermined mean value by eroding it with the above-mentioned solid particles. This layer of coke is, in fact, a layer whose thickness varying along the cracking tube, and after it has formed, its thickness is maintained about means values corresponding to a predetermined degree of coking in the tube. In an equivalent variant, in order to limit the amount of particles injected, it is possible to operate merely with a greatly reduced coke growth rate (e.g. dividing the coke growth rate by a factor of 5 or 10), without halting growth completely.

This relatively thin layer of coke (thickness lying in the range about 0.5 mm to about 4 mm, and preferably in the range 1 mm to 3 mm) protects the inside walls of the installation from erosion, particularly since this layer quickly becomes very hard and very difficult to break up or erode because of the progressive calcination of the coke which occurs while it is kept at high temperature (about 1000° C. at the wall). Once this layer of coke has formed and hardened, its thickness is kept substantially constant by continuously or substantially continuously eroding the coke at the same rate as it is deposited on this protective layer. In addition, the conditions for adjusting erosion using solid particles become less critical and a wider tolerance can be allowed on solid particle size, on the nature of the particles used, and on the way in which they are distributed in the vector gas.

Thus, the method need not necessarily perform decoking in the strict sense, but rather elimination of the more fragile recently-formed coke as and when it forms, thereby obtaining a substantially stationary coking state, or a coking rate which is very low.

The characteristic use in the invention of erosive particles which are very fine and therefore in much larger numbers for a given mass causes the number of impacts on the walls to be greatly increased for removing the thin film of new coke before it hardens. Particles may be injected continuously, or discontinuously, preferably at short intervals.

The invention also provides an installation for steam-cracking hydrocarbons, the installation comprising a steam-cracking furnace having tubes for conveying a flow of hydrocarbon feedstock, indirect quench means for quenching the gaseous products leaving the furnace, and liquid-injection direct-quency means connected to the outlet from the indirect-quench means, the installation being characterized in that it includes means for injecting solid particles into the vaporized hydrocarbon feedstock flowing through the installation while the installation is in operation, said solid particles having a mean diameter of less than about 150 μm and the ratio of solids to gas in the installation being very low, such that the gas and particle mixture behaves like a gas having the capacity to perform light erosion, the installation further including separator means, such as a cyclone, for separating the solid particles from the gas, said means being provided at the outlet from the indirect-quench.

Advantageously, the installation includes means for recycling through the installation solid particles separated from the gas, and means for a make-up of solid particles. This serves to compensate for the quantity of particles lost in the separation means, which although it may be very efficient, for example about 95% to 99%, is always less than 100% efficient. The installation also includes means for removing worn particles.

In an advantageous embodiment of the invention, the installation includes a tank for storing solid particles, the tank having an inlet connected to an outlet for solids from the above-mentioned separator means and having an outlet connected to a duct for injecting particles into the installation, isolation means for said tank, such as valves, and means for connecting said tank to a source of gas under pressure enabling the internal pressure of the tank to be raised to a value not less than the pressure at a point where particles are injected into the installation.

These recycling means are relatively insensitive to erosion since the solid particles pass through them at low speed, e.g. 20 m/s or less, and their lifetime is therefore long. In addition they are of ordinary design, they operate at a temperature of less than about 600° C., and they are therefore cheap.

The solid particles are transported to the injection points either by means of gravity flow or else in the form of a solid-gas suspension in dilute phase without it being necessary to use a vector gas flow at very high speed, thereby also reducing duct erosion.

The installation preferably includes a second tank mounted between the outlet of the separator means and the inlet of the first mentioned tank, together with means such as valves for isolating the second tank and means provided inside the second tank for retaining large particles. This second tank may alternatively be installed in parallel with the first tank.

The second tank serves to collect the solid particles recovered at the outlet from the separator means, while the first-mentioned tank is being emptied.

Solid particles at the outlet from the separator means can thus be stored temporarily, and it is also possible to filter the solid particles in order to retain large particles, e.g. flakes of coke detached from the walls.

According to yet another characteristic of the invention, the source of gas under pressure is connected to the duct for injecting particles into the installation. The flow of vector gas used for injecting particles into the installation then also serves to increase the pressure in the tank. Thus, by virtue of the pressure in the tank being balanced by the vector gas, any danger of excess pressure liable to compact the solid particles is avoided.

The vector gas may be constituted, for example, by a fraction of the feedstock or by the superheated steam.

In a variant, the means for recycling the solid particles comprise means for injecting a flow of gas containing no heavy aromatic compounds into the bottom portion of the separator means in order to form, together with the recovered solid particles, a gas-solid suspension at the outlet from said means, and an ejector-compressor connected to the outlet of the above-mentioned separator means and fed with an auxiliary flow of high pressure gas in order to recompress the gas-solid suspension on its way to its point of injection into the installation.

It has been observed that it is possible to inject fine particles at the inlet to an ejector and nevertheless to recompress the gas-solid suspension formed in this way. It is possible to recompress very heavy suspensions (200% or 300% by weight very finely divided solid) with compression ratios of about 1.5 to 1.8. The ejector serves not only to displace or project the particles, but also to achieve a very considerable rise in the pressure of the particles, thereby enabling them to be recycled by compensating for headlosses in the installation to be decoked.

The ejector is preferably made of a material which withstands erosion (cast iron or a ceramic).

When the steam-cracking furnace includes a manifold for feeding the tubes which convey the flow of hydrocarbon feedstock to be cracked, the invention provides means for injecting the solid particles into the vaporized hydrocarbon feedstock upstream from or at the inlet to the manifold, means for establishing a turbulent flow within the manifold at sufficient speed to avoid substantially any solid particles being deposited inside the manifold, feed endpieces mounted at the ends of the tubes and extending into the manifold, with each endpiece having an inlet section directed towards the upstream end of the manifold and having a component in a plane perpendicular to the mean direction of flow within the manifold; advantageously, means are also provided for capturing solid particles at the downstream end of the manifold.

By virtue of the turbulent flow inside the manifold, the gas-particle mixture throughout the entire manifold is properly uniform. The endpieces provided at the manifold ends of the tubes serve to ensure that the feed of particles to the tubes is regular and substantially constant, regardless of the positions of the tubes within the manifold. The inlet sections of the endpieces include front components facing the flow and serve to avoid excessive changes in direction at the inlets to the tubes, since such changes in direction would give rise to gas-particle separation phenomena and would lead to non-uniformity in particle distribution. These endpieces also constitute highly effective generators of turbulence inside the manifold. Finally, the means for capturing excess particles which are provided at the downstream end of the manifold serve to prevent the last tube in the manifold being overfed or obstructed by excess particles.

These means may be constituted, for example, by a filter, a settling chamber, and a cyclone or any equivalent means suitable for removing excess particles, and in particular heavier particles. These means may advantageously be placed in the downstream end zone of the manifold having, for example, the last two tubes, so as to capture the relatively heavy particles travelling along the bottom generator line of the manifold, thereby preventing these particles from feeding the last tube with an excess quantity of solids which would lead to a capacity for erosion very different from the mean value.

Advantageously, the installation includes means for taking off a fraction of the gas and solid particle flow in the manifold from the downstream end thereof, and recycling means for recycling the taken-off fraction of the gas and solid particle flow upstream from or at the inlet to the manifold.

The manifold then behaves like a manifold of infinite length without any "last" tube fed by the residual fraction of the gas-particle mixture.

Advantageously, the inlet to each tube has a constriction such as a throat or a venturi or a smaller diameter tube disposed downstream from the above-mentioned endpiece. Such a constriction serves to make the flow of gas along the various tubes more regular and uniform.

It also has an advantageous effect on the decoking of the inside walls of the tube: if coke is deposited more quickly in one tube than in another, then the coke will reduce the flow cross-section, thereby increasing the local flow speed, given that the constriction at the inlet to the tube tends to maintain a constant flow rate along the tube. This increase in local speed due to the constriction at the inlet serves to increase the rate of erosion by the particles, thereby correcting the tendency of the tube towards increased coke deposition.

Finally, the installation may advantageously include means for measuring pressure drop in the tubes of the stream-cracking furnace, means for measuring the flow rate of the hydrocarbon feedstock to be cracked or of the dilution steam, means for correcting the pressure drop as a function of the measured flow rate, and means for regulating the corrected pressure drop by controlling the rate of flow of recycled solid particles through the installation.

These means serve to maintain a protective coke layer of determined thickness on the inside walls of the installation, and also to avoid any significant increase in the thickness of said protective layer.

The invention will be better understood and other characteristics, details, and advantages thereof will appear more clearly on reading the following description given by way of example and made with reference to the accompanying drawings, in which.

Figure 8:
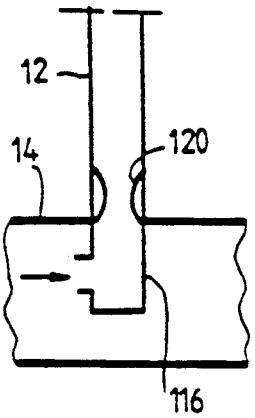
Figure 9:
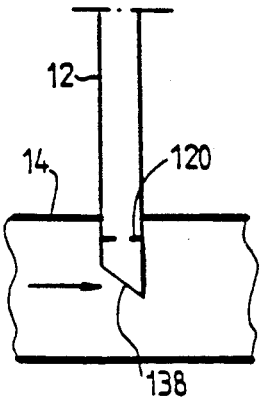
Figure 10:
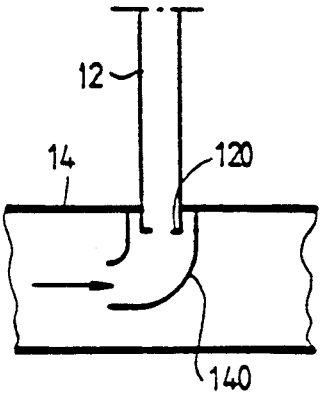
Figure 11:
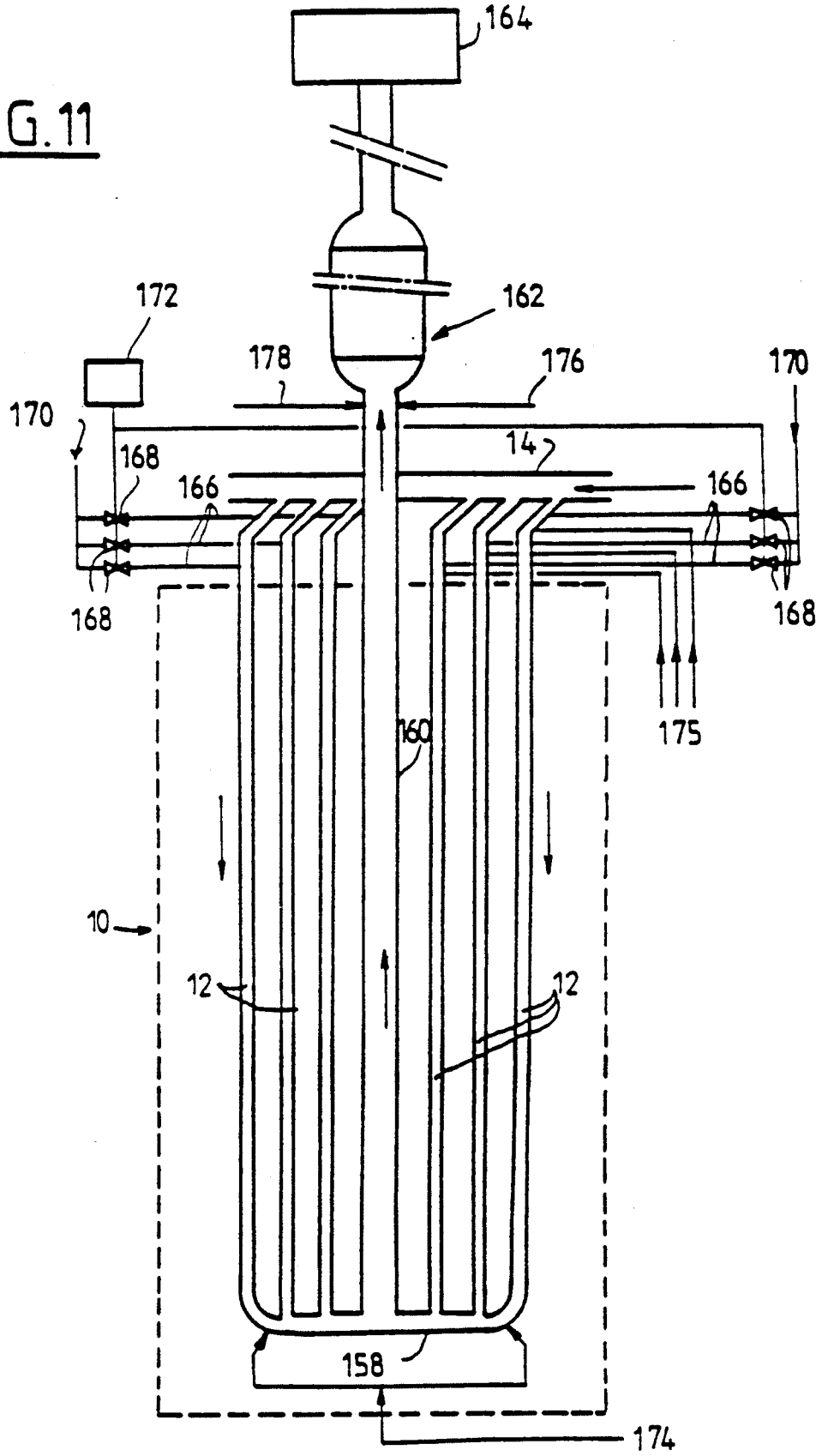

FIGS. 8, 9, and 10 are diagrams showing various embodiments of tube endpieces; and FIG. 11 is a diagrammatic view of a portion of a steam cracking installation constituting another variant embodiment of the invention.

Figure 1:
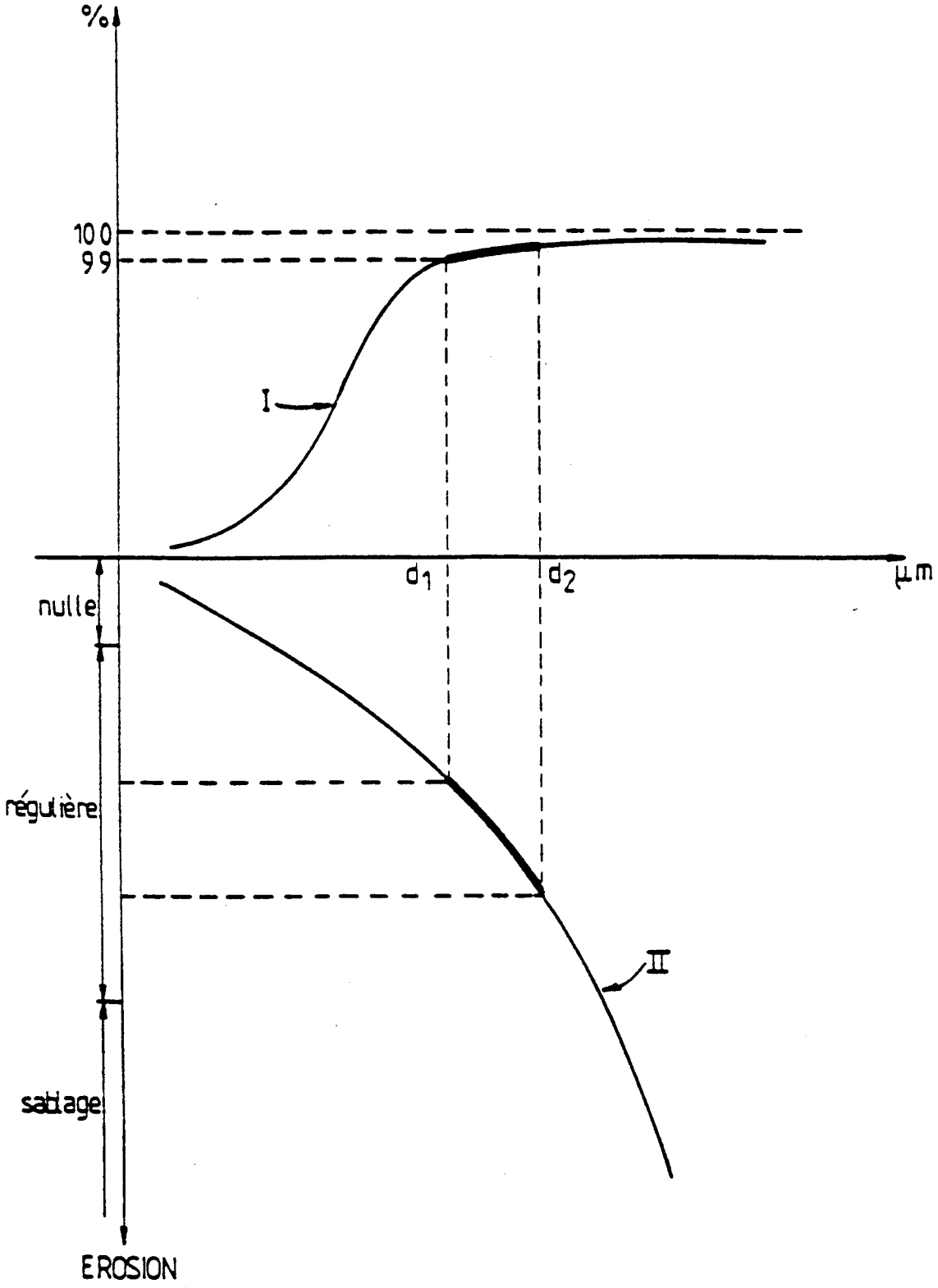
FIG. 1 shows curves representing the variation in the separation efficiency in a cyclone, and in the erosion capacity of solid particles, both as a function of particle size.

Reference is made initially to FIG. 1 in order to obtain a better understanding of the principle on which the invention is based.

In FIG. 1, reference I designates a curve showing the variation in separation efficiency of a cyclone as a function of the size of solid particles supplied to the cyclone. Reference II designates a curve showing the variation in the erosive capacity of solid particles as a function of their size.

The separation efficiency of a cyclone tends asymptotically towards 100% as the size of the solid particles increases beyond a value d1 at which the separation efficiency is 99%, for example.

The capacity for erosion of solid particles of this size is relatively low, and remains so over a range of sizes around d1.

When the solid particles are considerably smaller than d1, then the separation efficiency of the cyclone falls off significantly and the capacity for erosion of the particles becomes substantially nil. Conversely, as particle size increases significantly above d1, then cyclone separation efficiency is nearly equal to 100% and the capacity for erosion of the particles becomes very large and similar to sand blasting, with erosion becoming rough and irregular.

The invention provides for selecting a range of particle sizes d1, d2 over which cyclone separation efficiency is greater than a determined value, e.g. 95% or 99%, and the erosion produced by the particles is light and regular.

Figure 2:
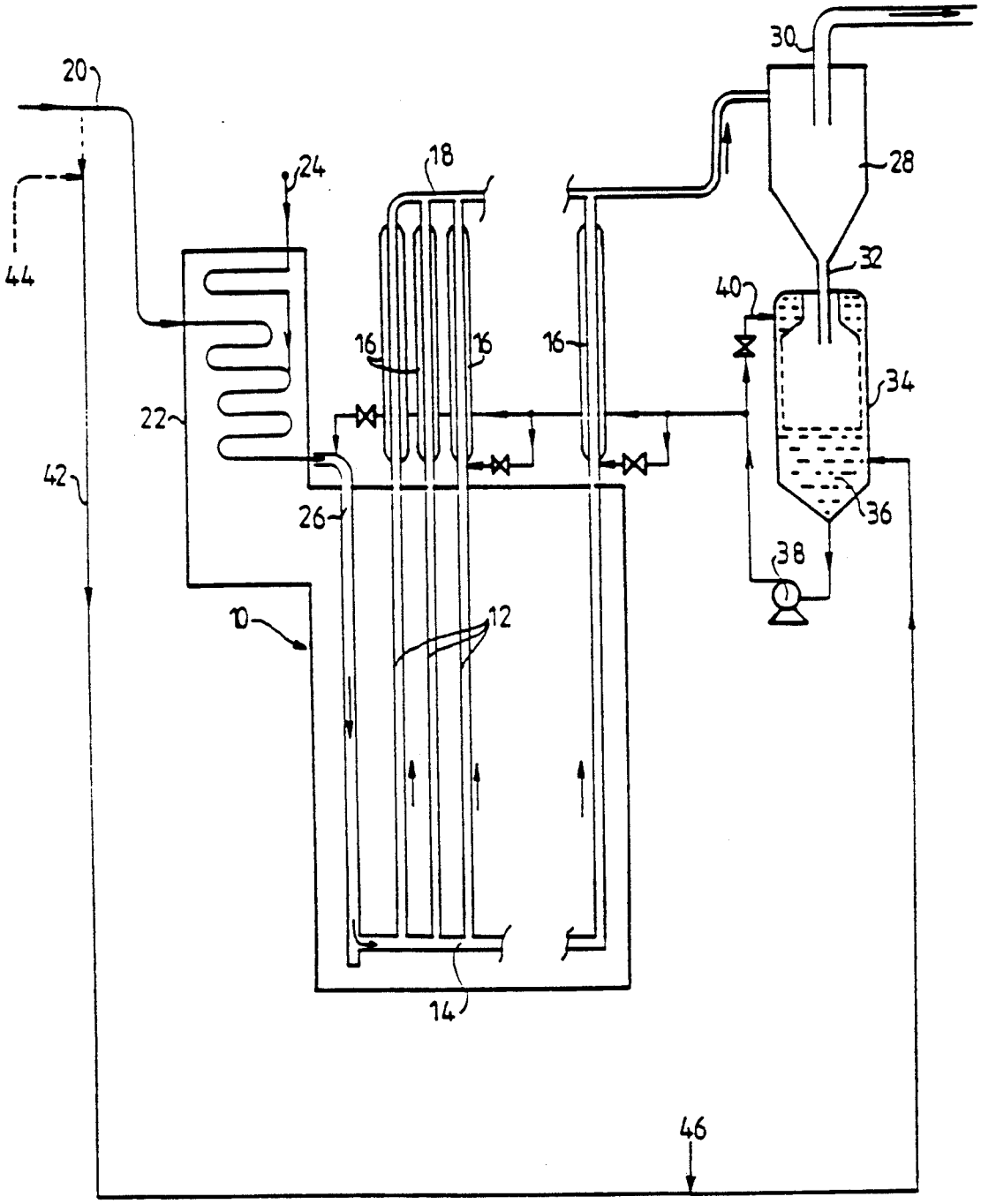
FIG. 2 is a diagram of a steam-cracking installation of the invention.

A steam-cracking installation of the invention is shown diagrammatically in FIG. 2.

This installation comprises a furnace 10 having singlepass tubes 12 fed with hydrocarbons at one of their ends by a manifold 14 and having their opposite ends at the outlet from the furnace fitted with individual quench boilers 16 connected to an outlet manifold 18. The feed of hydrocarbons to be vaporized is delivered in the liquid state via a duct 20 to a convection zone 22 of the furnace where it is heated and vaporized. A steam feed duct 24 joins the duct 20 in this zone 22 of the furnace 10. A preheat duct 26 feeds the mixture of vaporized hydrocarbons and steam to the manifold 14 feeding the steam cracking tubes 12.

The outlet manifold 18 is connected to a cyclone 28 or to a plurality of cyclones connected in series and/or in parallel and including a top duct 30 for delivering gaseous products, and a bottom duct 32 for delivering solid particles. The bottom duct 32 opens out into a tank 34 whose bottom is filled with a liquid 36 which may be water but which is preferably a light hydrocarbon liquid having substantially no pyrolysis heavy aromatic compounds. The base of the tank 34 is connected by a pump 38 to means for injecting the mixture of liquid and solid particles into various points of the installation, in particular at the inlet to the duct 26 or to the inlet manifold 14. Injection points may also be provided between the outlet from the furnace 10 and the inlets to the indirect-quench boilers 16.

Injection is preferably performed by spraying together with steam, or by vaporization by flash expansion, in which case the suspension must be reheated prior to injection by means not shown. It is also possible to add a flow of light hydrocarbons thereto.

Spraying conditions and liquid flow rate are designed to enable the sprayed suspension to vaporize completely as soon as it is injected (instantaneous vaporization in order to prevent particles from sticking).

A portion of the mixture of solid particles and liquid is returned, as shown diagrammatically at 40, to the top of the tank 34 so that the liquid forms a continuous film covering the entire inside wall of the tank 34, thereby trapping solid particles as they leave the duct 32. The liquid preferably flows continuously from a "source" line on the wall of the tank 34 and without forming droplets.

Vortex motion is imparted to the liquid 40 in order to increase its cleaning effect and the entrainment of particles over the wetted wall of the tank 34. The liquid fed at 40 has advantageously been allowed to settle so as to be substantially free from particles, and it is taken from the tank 34 by a special pump, not shown.

The hydrocarbon liquid used in the tank 34 may be a fraction of the hydrocarbon feedstock for cracking, which fraction is delivered to the bottom of the tank by a duct 42. Recycled pyrolysis gasoline may optionally be added to this fraction of the hydrocarbon feedstock, as shown diagrammatically at 44, or else it may constitute the liquid 36 directly.

Means are provided, e.g. at 46 on the duct 42, for a makeup of solid particles, possibly in the form of a suspension of solids in a hydrocarbon liquid or in water.

This installation operates as follows:

The hydrocarbon feedstock for cracking is preheated, mixed with steam, and vaporized in the portion 22 of the furnace 10, after which it is subjected to steam cracking in the tube 12 of the furnace with a very short transit time in these tubes. The gaseous products of steam cracking are then subjected to indirect quenching in the boilers 16 after which they pass through the cyclone 28 where the solid particles are removed therefrom, and then they are delivered to means for direct quenching by injecting pyrolysis oil.

Relatively large amounts of coke form on the inside walls of the duct 26, of the manifold 14, and above all on the tubes 12 of the furnace and the tubes of the boilers 16.

The solid particles conveyed by the vaporized hydrocarbon feed serve to eliminate the coke by light and regular erosion of the layer of coke as it forms on the walls of the installation.

Most of the solid particles are then separated from the products of steam cracking by the cyclone 28, from which they go to the tank 34 where they are mixed with the liquid 36 in order to form a liquid-solid suspension. The pump 38 serves to recycle these particles through the installation by recompressing the solid-liquid suspension to a pressure appropriate to the points of injection.

The solid particles that are not separated from the flow of gas in the cyclone 28 are trapped subsequently by the liquid injected into the gas flow for performing direct quenching.

In general, the solid particles used have a mean size of less than about 150 μm, with the concentration of solid particles in the gas flow being less than 10% by weight relative to the gas. Preferably, particles are used having mean sizes lying in the range 5 μm to 85 μm, or better still in the range 15 μm to 60 μm, with a solid to gas ratio lying in the range 0.1% to 8%, e.g. in the range 0.1 to 3%.

The "mean size" of the particles is, for example, such that 50% of the mass of the particles have a diameter smaller than said size.

Substantially spherical particles can be used, e.g. silica-alumina particles, such as used catalyst particles for catalytic cracking (silico-aluminates, produced by spraying).

These particles of cracking catalyst (silica-aluminates, zeolite), are substantially spherical in shape and have proved highly effective for removing coke while being substantially harmless for the metal of a test reactor.

In a variant, two types of particles may be used, one of the types being coke-catalyzing metal particles, particles of iron, steel, or nickel, or of an alloy containing nickel, which particles are relatively soft under steam-cracking conditions, while the particles of the other type are harder and more erosive (e.g. cracking catalyst particles or particles made of a hard refractory metal alloy).

These particles may also be preheated prior to being injected into the installation in order to avoid any problems of condensation where they are inserted into the steam-cracking furnace. The preheat temperature is preferably higher than the local dew point at the point of injection.

An installation may be decoked by means of such particles on a continuous basis, or discontinuously.

Advantageously, a relatively thin first layer of coke, e.g. having a thickness lying in the range 0.5 mm to 4 mm, or preferably in the range 1 mm to 3 mm, may be allowed to form on the inside walls of the installation, which layer hardens fairly quickly. This very hard layer provides effective protection for the metal walls of the installation. The coke which tends to be deposited subsequently on this protective layer is removed as it forms by erosion by the solid particles conveyed by the hydrocarbon feed.

It may also be observed that the vector gas conveying the solid particles in the installation is rich in steam which plays an important role in constituting a layer of oxide (essentially chromium oxide) on the inside surface of the tubes of the furnace. It is thought that this very hard film of oxide also protects the metal of the tubes against erosion by the solid particles of the invention.

Thus, the process takes advantage of three different physical phenomena:

the coke is lightly eroded with a high degree of uniformity and without fragmentation by using an erosive gas which is constituted by small quantities of very fine particles distributed throughout the mass of the gas which flows at high speed and which does not react together;

the tubes are protected by a prelayer of hardened coke constituting a shield of controlled thickness which is less sensitive than newly-formed coke to erosion by the erosive gas; and the very fine particles used attack the metal of the tubes very little under the local oxidizing conditions.

The gaseous products pass through the cyclone at an intermediate temperature, in general less than about 600° C., so the cyclone may be made of low-alloy steel, i.e. cheap steel. The effectiveness of the cyclone at separating out the solid particles is better than it would be at high temperature because of the lower viscosity of the gases. Finally, solid particle separation is performed at a temperature where the speed of cracking reactions is low. It therefore does not give rise to secondary supercracking chemical reactions which would take place if the solid particles were separated out immediately at the outlet from the furnace 10.

Figure 3:
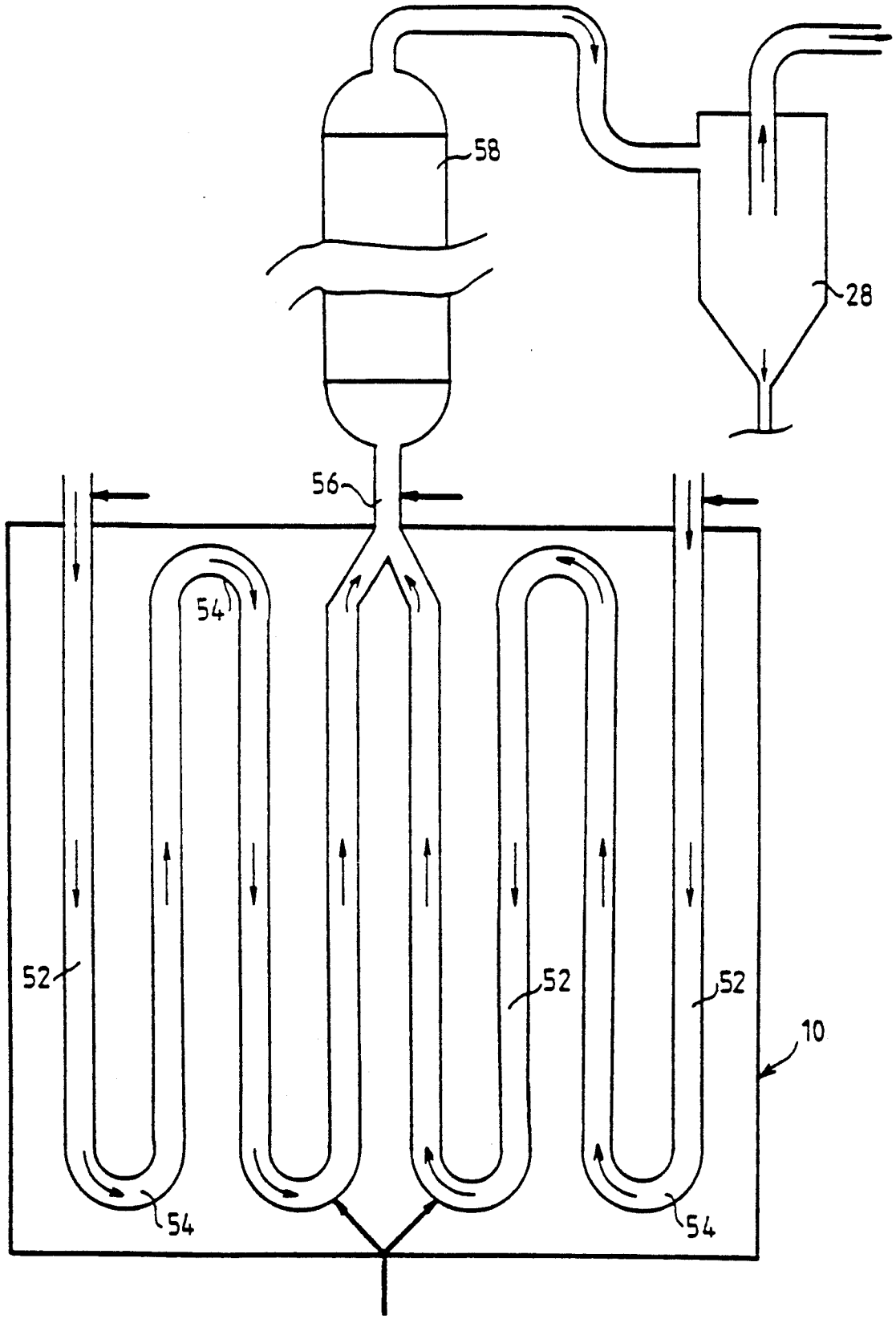
FIG. 3 is a diagram of another steam-cracking installation of the invention.

FIG. 3 shows another steam-cracking installation of the invention.

This installation is of the multipath sinuous tube or "coil" type with the steam-cracking furnace 10 being fitted with tubes 52 having rectilinear lengths interconnected by bends 54. A manifold 56 interconnects the tubes at the outlet from the furnace 10 and is connected to an indirect-quench boiler 58. A cyclone 28 receives the gaseous products leaving the quench boiler and separates out the solid particles.

Particles may be injected into the installation at three points: at the inlet to the furnace 10; at the beginning of the last rectilinear lengths of the tubes; and at the inlet to the quench boiler 58.

Figure 4:
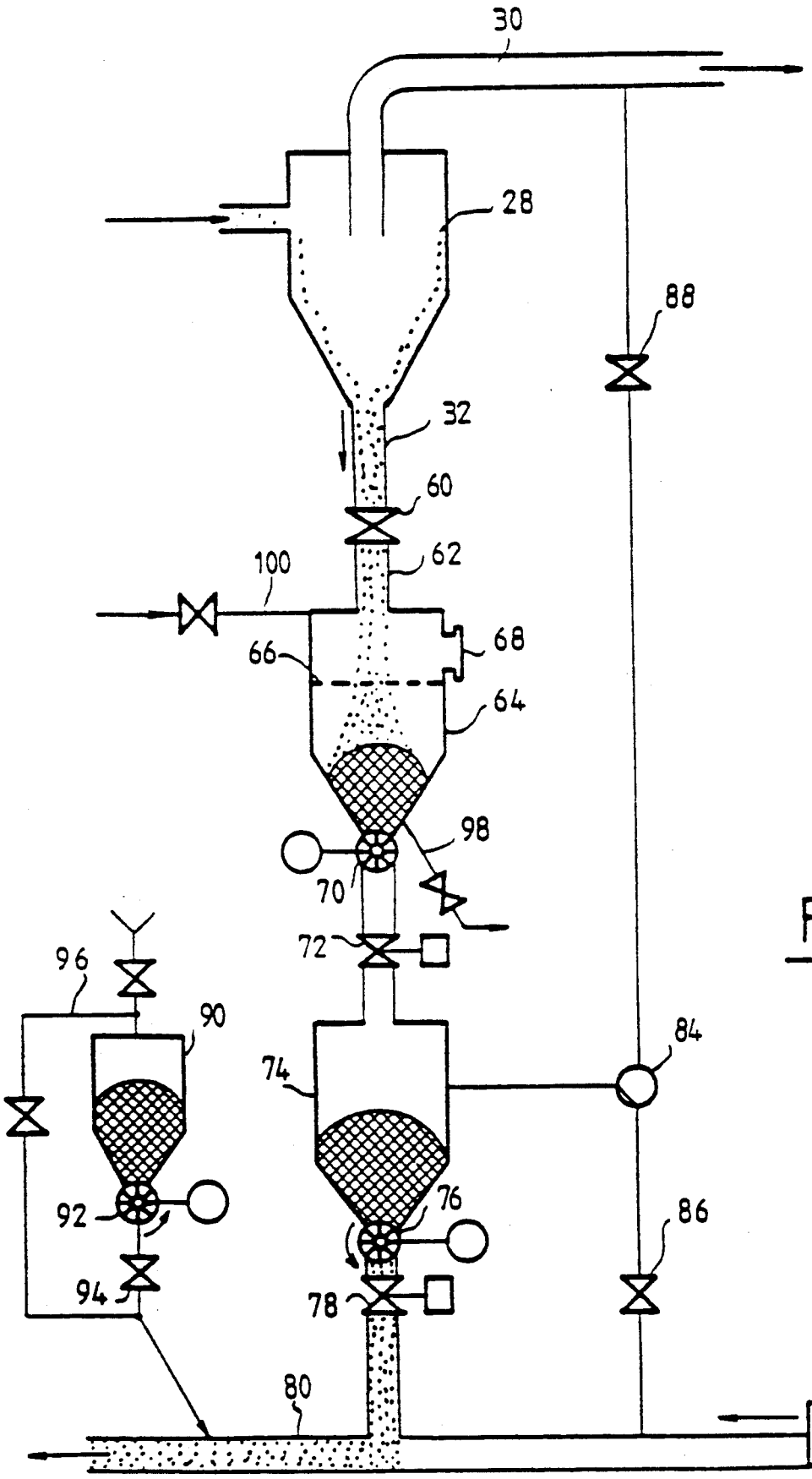
FIG. 4 is a diagram of a portion of the means for recycling solid particles.

FIG. 4 is a diagram of a variant embodiment of the solid particle recycling means.

In this variant, the bottom of the cyclone 28 is connected via an isolating valve 60 to the top inlet 62 of a tank 64 including means 66 such as a vibrating screen for separating out and retaining the largest solid particles, together with an orifice 68 for removing these particles (a manhole).

The bottom portion of the tank 64 in which the fine solid particles collect is connected to a motorized rotary member 70 such as a screw, a rotary lock, or the like, and via an isolating valve 72, to the inlet of another tank 74 whose bottom outlet includes a motorized rotary member 76 and an isolating valve 78 which are identical to the member 70 and the valve 72 described above. The outlet from the tank 74 is connected by the valve 78 to a duct 80 for recycling the solid particles in the steam-cracking installation. A source 82 of gas under pressure feeds the duct 80 with a flow of gas at medium speed or at relatively low speed (e.g. a flow of superheated steam travelling at 20 m/s).

A three-port valve 84 serves to connect the tank 74 either to a source of gas under pressure 82 or else to the outlet duct 30 from the cyclone. The ducts connecting the three-port valve 84 to the source of gas under pressure 82 and to the duct 30 are provided with respective stop valves 88.

An independent tank 90 filled with new solid particles of determined mean grain sizes serves, via a motorized rotary member 92 and an isolating valve 94, to inject solid particles into the duct 80 for topping-up purposes. The top portion of the tank 90 is connected to the output from said tank via a duct 96 which serves to balance pressures.

The rotary member 92 serves to regularize the flow rate of topping-up particles.

The bottom of the first tank 64 (or the tank 74) may be provided with a purge duct 98 for removing a certain quantity of worn solid particles, while a duct 100 for delivering a controlled input of a barrage gas opens out into the top of the tank 60. The barrage gas is free from heavy aromatic compounds and may be steam. It serves to prevent the tank 64 and the screen 66 coking up by preventing cracked gases being present.

These recycling means operate as follows:

Assume initially that the upstream valve 60 of the first tank 64 is open, that the rotary outlet member 70 from this tank is not rotating, and that the downstream isolation valve 72 is closed. The solid particles separated in the cyclone 28 from the gaseous products are collected and stored in the tank 64 after being filtered by the screen 66 which removes the particles of largest size. The barrage gas delivered by the duct 100 prevents any heavy aromatic compounds entering the tank while not interfering with the gravity fall of the particles down the duct 32.

During this stage, the bottom tank 74 which has been filled previously with solid particles from the top tank 64 is progressively emptied of these solid particles which are reinjected into the duct 80. To do this, the isolation valve 78 downstream from this tank is open, the rotary member 76 is rotating, and the inside volume of the tank 74 is connected to the source of gas under pressure 82 by the valve 84, while the bottom stop valve 86 is open. The gas delivered by the source 82 is at a pressure which is not less than and may be slightly greater than the pressure at the point where the solid particles are injected into the installation, which pressure is greater than the pressure in the outlet duct 30 from the cyclone 28. The pressure inside the tank 74 is thus greater than the pressure inside the top tank 64, and it is in equilibrium with the pressure in the recycling duct 80. The source 82 delivers a flow of gas into this duct at relatively low speed, lying in the range 5 m/s to 25 m/s, e.g. superheated steam flowing at a speed lying in the range 10 m/s to 20 m/s, thereby conveying the solid particles in diluted gaseous suspension to at least one of the points of injection in the installation. When the tank 74 is empty or nearly empty, the rotary member 76 is switched off, the valve 78 is closed, and the tank 74 is connected to the outlet duct 30 of the cyclone via the three-port valve 84. The tank 74 is then at the same pressure as the top tank 64 and it suffices to open the isolation valve 72 and to switch on the rotary member 70 to cause the solid particles contained in the tank 64 to be transferred into the tank 74.

Thereafter, the rotary member 70 is switched off, the valve 72 is closed again, the tank 74 is connected to the source of gas under pressure 82, the valve is opened again, and the rotary member 76 is switched on again to inject solid particles into the duct 80.

Whenever necessary, the purge duct 98 serves to remove a flow of solid particles from the tank 64, which flow is constituted by a mixture of abrasive particles from the topping-up tank that have been subjected to a degree of attrition by virtue of flowing through the installation together with particles of coke that have become detached from the inside walls of the installation.

Figure 5:
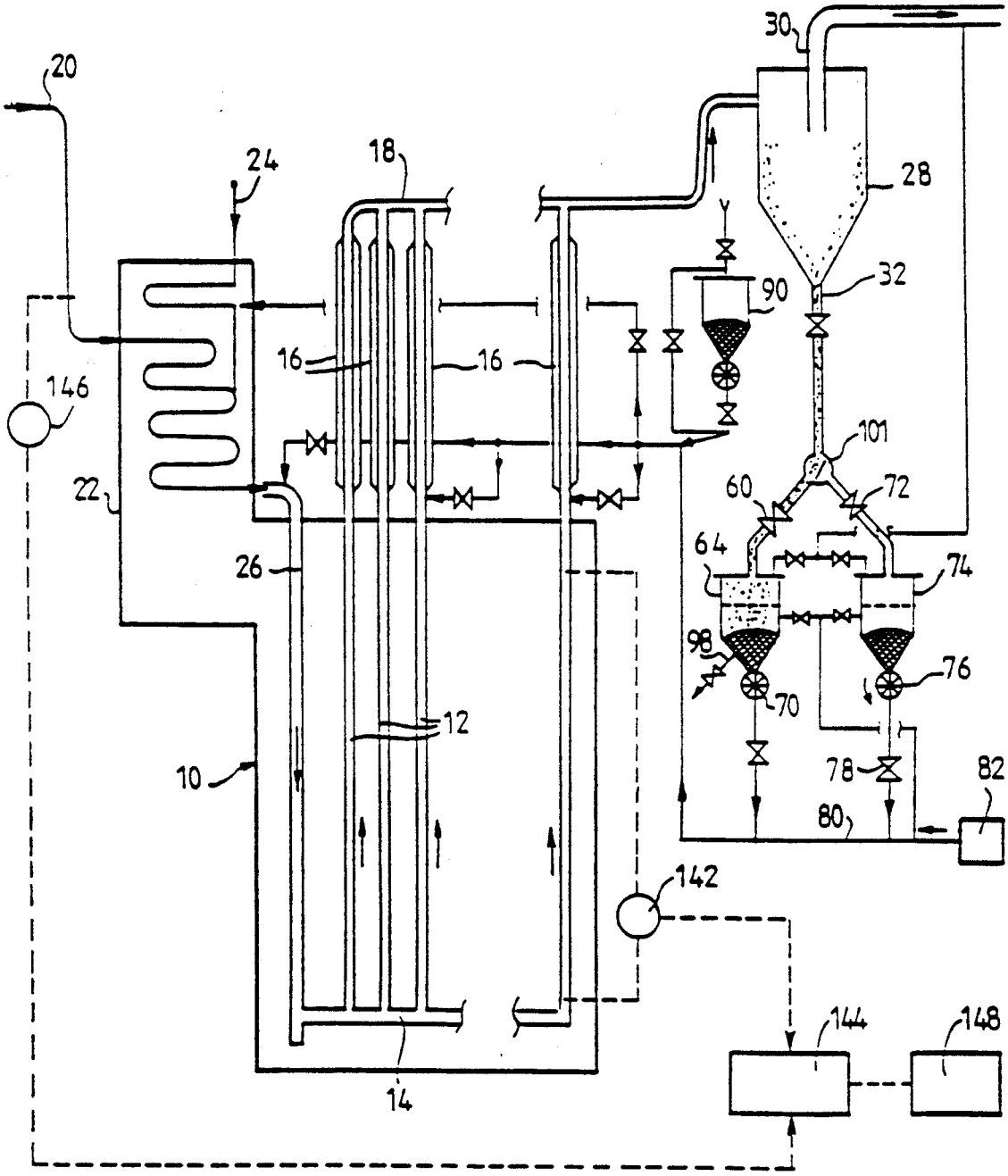
FIG. 5 is a diagram of a complete steam-cracking installation constituting a variant embodiment of the invention.

In the variant embodiment of FIG. 5, the two tanks 64 and 74 are connected in parallel between the outlet from the cyclone 28 and the recycling duct 80, and they are used in alternation, with one of them storing solid particles coming from the cyclone while the other one is injecting them into the duct 80. A flap valve 101 provided at the outlet from the cyclone 28 serves to feed one or other of the tanks with particles.

Otherwise operation is similar to that of the recycling means shown in FIG. 4. Solid particles may be recycled through the installation at the inlet to the duct 26, at the inlets to the indirect-quench boilers 16, and into the duct 24 for cleaning the feedstock vaporizing duct situated in the portion 22 of the furnace (e.g. when the feedstock is fully vaporized and prior to it being mixed with steam).

The installation shown in FIG. 5 also includes means 142 for measuring the real pressure drop in the tubes 12 of the furnace in order to discover the increase in this pressure drop due to a layer of coke being formed on the inside wall of each of the tubes. The means 742 for measuring headloss in the furnace tubes are connected by a correction circuit 144 associated with means 146 for measuring the flow rate of hydrocarbon feedstock to a logic control circuit 148 serving to regulate the real pressure drop in the tubes of the furnace to a value lying in the range about 110% to about 300% of the value of said pressure drop in a clean tube under the same furnace operating conditions (same hydrocarbon feedstock and same steam flow rate). The real pressure drop in the furnace tubes (corrected as a function of flow rate) is preferably maintained at a value lying in the range about 120% to about 200%, e.g. in the range 130% to 180%, of the pressure drop in clean tubes. To do this, the control circuit 148 may act on the following means:

The quantity of topping-up solid particles delivered by the tank 90;

the purging of the tank 64 by the duct 98; and the cycle frequency and the flow rate at which the solid particles from the tanks 64 and 74 are recycled.

This regulation of corrected real pressure drop in the furnace tubes corresponds to regulating the thickness of the layer of coke maintained on the inside walls of the tubes, said thickness lying in the range 0.3 mm to 6 mm, for example, and preferably in the range 0.5 mm to 4 mm, or better still in the range 1 mm to 3 mm, thereby protecting the tubes against the risk of being eroded by the solid particles.

The various means of the invention described with reference to FIGS. 4 and 5 are applicable to hydrocarbon steam-cracking installations in general, regardless of the types of tube used in the furnace and the manner in which the solid particles are separated out and recycled.

Figure 6:
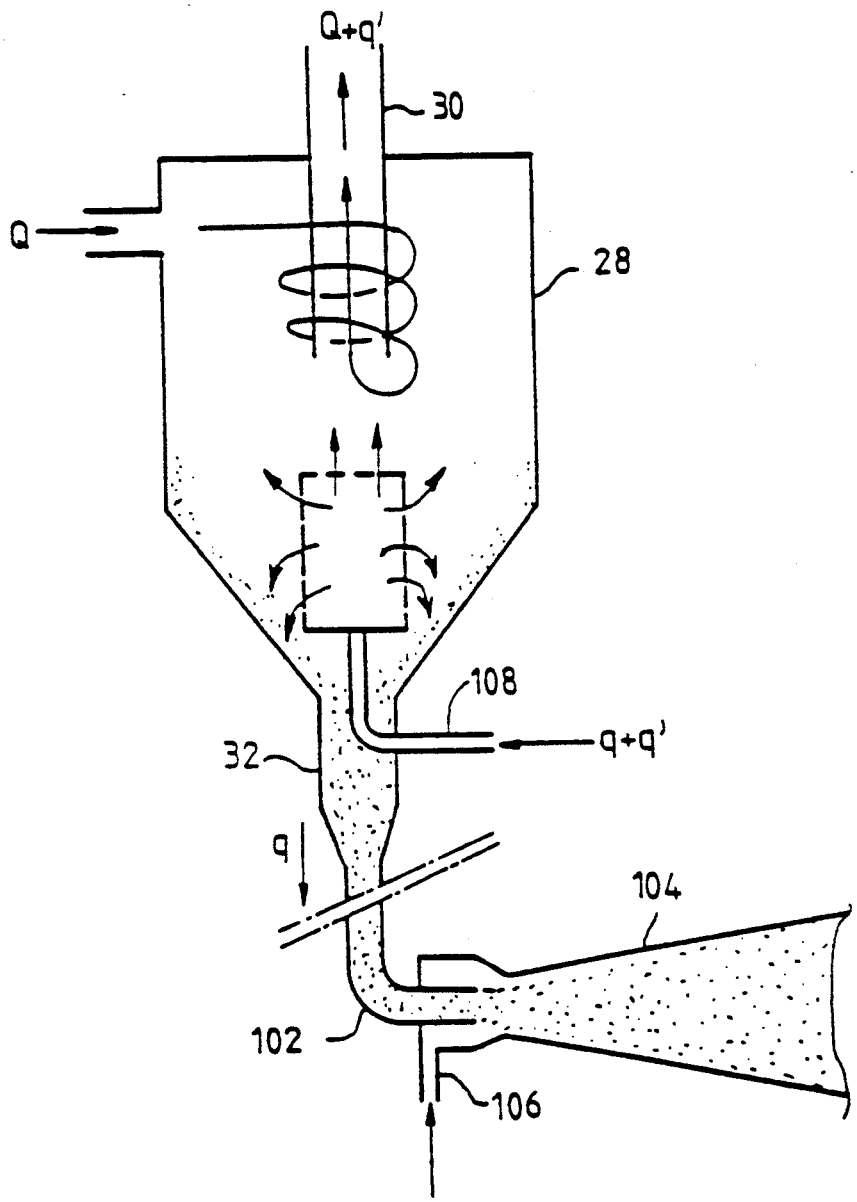
FIG. 6 is a diagram of a portion of a variant embodiment of the recycling means.

FIG. 6 shows another variant of the recycling means.

In this variant, the bottom outlet 32 of the cyclone 28 is connected to an axial inlet 102 of an ejector-compressor 104 having a peripheral inlet 106 which is fed with a flow of driving gas under high pressure. The annular space between the axial speed 102 and the outer wall of the ejector-compressor 104 constitutes an accelerating nozzle for the high pressure drive gas fed in via the peripheral inlet 106. The outlet from the ejector compressor is connected to a duct for injecting the gas-solid suspension into the installation.

A duct 108 also serves to inject an auxiliary gas flow $q+q'$ into the bottom portion of the cyclone 28 in order to form a gas-solid suspension at the outlet from the cyclone 28.

Under these conditions, the ejector-compressor 104 takes off the flow q of the auxiliary gas from the cyclone 28 as required for forming the gas-solid suspension. The excess flow $q'$ of auxiliary gas injected into the cyclone leaves the cyclone via its top, together with the inlet gas flow Q to the cyclone. The particles recovered in the cyclone are thus picked up by a flow q of auxiliary gas which is different in nature from the cracked gases, the suspension is recompressed in the ejector-compressor, and the recompressed suspension is recycled into the installation.

The recompression of the gas-solid suspension performed by the ejector-compressor 104 suffices to compensate for the headloss between the points of injection into the installation and the inlet point into the ejector-compressor 104.

The auxiliary gas fed to the ejector-compressor may be steam, or else a heavy gas having a chemical composition such that the speed of sound in this gas is considerably lower than the speed of sound in steam. This may be used to limit the flow speed through the ejector-compressor which speed is related to the speed of sound, thus limiting erosion in the ejector-compressor. This gas is nevertheless selected to have no heavy aromatic compounds since they would increase coking of the furnace on being recycled.

A major portion of the auxiliary gas may be constituted, for example, by fractions of pyrolysis products recycled after hydro-treatment, e.g. fractions boiling in the C4 range and pyrolysis gasolene.

In a variant, the ejector-compressor may alternatively be conventional in type (with a central axial drive gas feed), and made of materials that withstand abrasion (internal lining of ceramic or carbide). Heavy particles may advantageously be filtered out at the inlet to the ejector-compressor.

Figure 7:
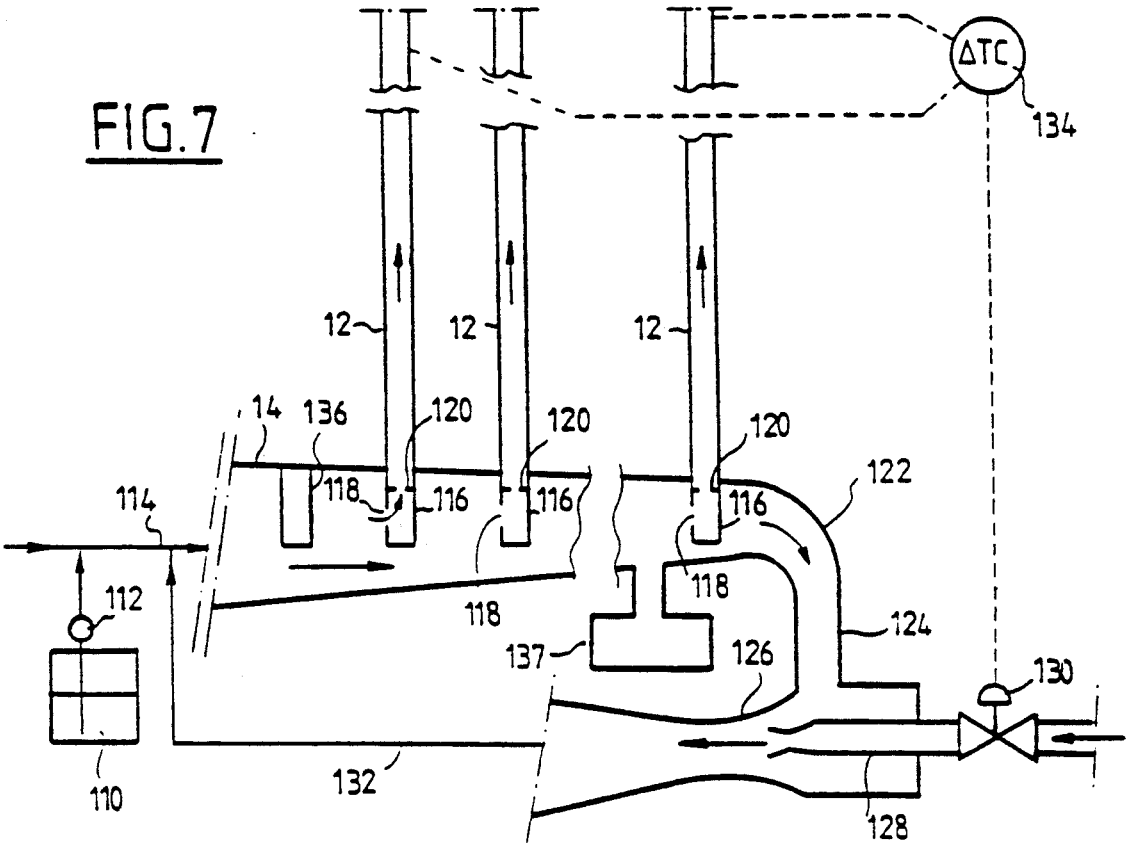
FIG. 7 is a fragmentary diagrammatic view of a steam cracking installation including means for distributing solid particles.

FIG. 7 is a diagram of means for distributing or sharing solid particles between the tubes 12 of the steam-cracking furnace. These tubes 12 are small diameter parallel rectilinear tubes whose ends are connected to a feed manifold 14 and to an outlet manifold (not shown) that may be situated beyond a primary quench heat exchanger.

The manifold 14 is fed with vaporized hydrocarbon feedstock and with steam which may be a temperature of about 550° C., for example, and a small quantity of small sized solid particles are injected therein, which particles are stored in a tank 110 in the form of a suspension in a liquid such as water or light to medium hydrocarbons. A pump 112 takes the mixture of liquid and solid particles from the tank 110 and injects it into the flow of steam and vaporized hydrocarbon feedstock in a duct 114 upstream from the manifold 14.

The furnace tubes 12 constitute one or more parallel rows and they open out into the manifold 14 at regular intervals, the section of the manifold tapering progressively from its upstream end towards its downstream end relative to the feedstock flow direction so as to maintain a minimum speed of flow for the mixture in the manifold, thereby avoiding particle deposition.

The end of each of the tubes 12 opening out into the manifold 14 includes a feed endpiece 116 extending into the manifold and having an inlet section or orifice 118 directed towards the upstream end of the manifold and having a significant component extending in a plane perpendicular to the mean direction of feedstock flow in the manifold. Immediately downstream from its feed endpiece 116, each tube 12 includes a constriction 120 in the form of a throat or a venturi for making the flow of gas along the tubes 12 uniform and substantially constant. Advantageously a sonic venturi is used.

Immediately upstream from the last tube 12 and at the bottom of the manifold 14 there is a settling chamber 137 for collecting heavy particles travelling along the bottom generator lines of the manifold 14.

The downstream end 122 of the manifold 14 is connected by a duct 124 of appropriate dimensions to an ejector-compressor 126 comprising an axial duct 128 for being fed with a flow of drive gas such as steam. A valve 130 serves to control the flow rate of the drive gas.

The outlet from the ejector-compressor 126 is connected by a duct 132 to the upstream end of the manifold 14 or to the duct 114 for conveying the hydrocarbon feedstock.

Advantageously, the valve 130 for controlling the flow rate of the drive gas may itself be controlled by a system 134 including means for detecting the skin temperature of the first and last tubes 12 of the furnace in order to servo-control the drive gas flow rate to the difference between these temperatures. The device operates as follows:

The feed of steam and vaporized hydrocarbons conveying small sized solid particles flows with a high degree of turbulence along the manifold 14. The mean flow speed in the manifold lies in the range 20 m/s to 120 m/s, e.g. in the range 30 m/s to 80 m/s, and is significantly less than the speed of flow in the tubes 12 which lies in the range about 130 m/s to 300 m/s, and in particular in the range 160 m/s to 270 m/s. This speed of flow in the manifold 14 is sufficient to prevent solids separating out from the gas inside the manifold and thus to prevent any deposit of solid particles building up inside the manifold, except possibly for certain heavy particles travelling along the bottom generator line.

By removing a considerable fraction of the solid particle and gas flow from the downstream end 122 of the manifold, the manifold is transformed, so to speak, into a manifold of infinite length so that the downstream end of the manifold has no appreciable influence on the distribution of gas and particle flow between the various tubes 12 regardless of how close or distant they may be relative to the downstream end of the manifold.

By feeding a flow of drive gas (e.g. steam) into the ejector 126, it is possible to extract a desired fraction of the gas and solid flow in the manifold and to recompress this fraction for recycling by being injected into the duct 114 or into the upstream end of the manifold. The system 134 serves to control the flow rate of the drive gas by acting on the valve 130, thereby having an effect on the solid particle feed to the first tubes relative to the last tubes, and thus serving to correct irregularities in distribution, as detected by differences in the skin temperatures of these tubes.

The solid particles which flow along the tubes 12 erode the layer of coke which forms on the inside walls of these tubes. Variations in the skin temperatures of the tubes serve to evaluate the degree of coke build-up in the tubes clogging, and thus the effectiveness of the erosion of the layer of coke by the solid particles. Increasing the flow rate that is taken off increases the mean flow rate in the manifold, and this increase is larger at the downstream end of the manifold than it is at its upstream end. The take-off rate at the end of the manifold may thus be modulated as a function of the information about the relative clogging of the various tubes. More simply, it may be adjusted to an appropriate value.

The constrictions 120 formed at the upstream ends of the tubes 12 have the effect of causing the flow rates of the gases inside the tubes to be uniform and substantially constant. This gives rise to a possibility of automatically regulating the cleaning of these tubes by the solid particles. If coke builds up abnormally in a tube, thereby partially obstructing the tube, then since the feed gas flow rate is maintained by the constrictions 120, the flow rate past the coke build-up will be increased, thereby improving erosion efficiency.

In order to regularize and distribute the flow of gas and particles properly between the various tubes, a dummy feed endpiece 136 is disposed upstream from the first tubes 12, said dummy endpiece being identical to the feed endpieces 116 of the tubes. This means that the first tubes 12 are in the same aerodynamic situation as the following tubes.

FIGS. 8, 9, and 10 show various embodiments of the ends of the tubes 12 and of their feed endpieces.

In FIG. 8, the endpiece 116 is identical to those shown in FIG. 7, but the constriction 120 is constituted by a venturi having a throat which is preferably sonic. The venturi is made of a material which is particularly hard in order to withstand erosion, e.g. tungsten carbide or silicon carbide.

In FIG. 9, each tube 12 is terminated by a chamfer cut endpiece 138, having a chamfer cut, thereby forming the inlet end for the flow of gas and solid particles into the tube.

In FIG. 10, each feed endpiece is constituted by a 90° bend 140 which is fixed to the inside wall of the manifold 14 and which has the end of the corresponding tube 12 opening out therein, said end including the constriction 120.

The tubes 12 may be the furnace tubes, or else they may be flexible ducts (pigtails) which feed the furnace tubes.

FIG. 11 shows another variant of a steam-cracking installation of the invention.

In this figure, the steam-cracking furnace 10 comprises a series of small-diameter rectilinear tubes 12 fed at their upstream ends by a manifold 14 situated outside the furnace and interconnected at their downstream ends by a manifold 158 (optionally insulated) situated inside the furnace 10. The manifold 158 feeds a larger-diameter rectilinear tube 160 whose outlet end is connected outside the furnace to an indirect-quench boiler 162 using the product gases of the steam cracking. The outlet from the boiler 162 is connected to direct quench means 164 for the product gases.

The injected particles are recovered between the boiler 162 and the quench means 164 by means that are not shown.

In this installation, the steam-cracking feedstock constituted by a mixture of hydrocarbons and steam is delivered to the manifold 14, flows along the small tubes 12, and then flows in the opposite direction along the larger-diameter tube 160, leaving the furnace, and passing through the indirect-quench heat exchanger 162, to reach the direct-quench means 164 after the particles have been recovered. This installation is known as a two-pass "split coil" type installation.

For decoking the installation while it is in operation, the steam injection ducts 166 for injecting steam or a mixture of steam and hydrogen are connected to the upstream ends of the small-diameter tubes 12 outside the furnace 10. Each duct 166 includes a valve or other analogous opening and closing means 168 and is connected to means 170 for feeding it with steam or a mixture of steam and hydrogen. The valves 168 of the various ducts 166 are connected to sequential opening and closing control means 172 such that only one valve 166 or a very small number of the valves are open at any one time, with the other valves being closed. The flow rate of steam or of the mixture of steam and hydrogen injected into one of the small tubes 12 is adjusted so that it prevents the steam-cracking feedstock entering the tube.

The installation also includes means for injecting erosion solid particles into the upstream end of the large tube 160, preferably at the upstream ends of the manifold 158 feeding this large tube. These means are shown diagrammatically in the drawing and designated by reference 174.

As shown diagrammatically to the right of the drawing, it is also possible to provide means 175 for injecting a very small quantity of solid particles into the upstream ends of the small-diameter tubes 12. Another substantially equivalent possibility consists in injecting the particles into the inlet manifold 14 or upstream from this manifold. In this case, it is possible initially to perform partial decoking of the tubes 12 by means of solid particles, and to terminate decoking by injecting steam.

It is advantageous to provide means 176 for injecting additional solid particles directly into the inlet of the indirect-quench boiler 162 in order to improve decoking thereof.

Provision is also made for injecting a gas 178 at this point, i.e. at the inlet to the boiler 162, the gas being cooler than the gaseous products of steam cracking, thereby prequenching the products, with the prequenching being limited to about 150° C., and lying in the range 50° C. to 130° C., for example.

The prequenched gas may be cooled cracked ethane, or possibly recycled pyrolysis gasoline, preferably hydro-treated, e.g. fractions C5 or C6 having a low octane number after benzene extraction.

Prequenching serves to avoid or limit postcracking of the products at the outlet from the furnace 10.

The injection of steam into the furnace tubes 12 serves to decoke these tubes by a gas and water reaction. The steam leaving the tubes 12 at their downstream ends mixes in the manifold 158 with the steam-cracking feedstock. This sequential decoking of the first pass tubes 12 of the furnace therefore takes place without any specific steam consumption since the steam in question is recovered and used as dilution steam in the second pass 160 of the furnace. The valves 168 are opened sequentially, each being opened for a predetermined length of time. Erosive solid particles may be injected simultaneously or otherwise into the manifold 158 and into the inlet of the boiler 162.

A cyclone interposed between the quench boiler 162 and the direct-quench means 164 serves to separate the erosive solid particles from the flow of gaseous products.

In general, the method of the invention is well adapted to single-pass cracking installations, using rectilinear small-diameter tubes without bends, as described with reference to FIGS. 2 and 10.

The installation of FIG. 11 shows that the invention is also well adapted to an installation having two or more passes, without running the risk of erosion at the changes of flow direction (small or zero quantities of particles at these points).

Finally, the invention may also be used in installations having sinuous paths or "coils", in particular by using a prelayer of hardened coke and by careful control of particle injection.

The invention thus provides a considerable improvement in the steam-cracking industry.

I claim:

1. A method of decoking a hydrocarbon steam-cracking installation which includes a steam cracking furnace and an indirect quench boiler, said method comprising eroding away at least a portion of the coke deposited on the inside walls of the installation by introducing solid particles having a mean diameter of less than about 150 μm into said installation and by conveying the particles by a high speed flow of a vector gas through said installation while the installation is in hydrocarbon cracking operation, said vector gas comprising, at least in part, the hydrocarbon feed stock mixed with steam, and said solid particles and said vector gas forming a very low ratio of solid particles to gas, such that the resulting mixture of solid particles and vector gas behaves as a gas and performs light erosion of said coke deposited on the inside walls of the installation, thereby decoking said hydrocarbon steam-cracking installation during normal operation of said installation.

2. A method as claimed in claim 1, comprising the further steps of cooling the mixture of vector gas and solid particles at the outlet from the steam-cracking furnace to an intermediate temperature less than about 600° C., said temperature being chosen to prevent any liquid condensing, separating at least a major portion of the solid particles from the vector gas in at least one cyclone, raising the pressure of at least a portion of the solid particles separated from the gas in the cyclone, and recycling the particles through the steam-cracking installation.

3. A method as claimed in claim 1, wherein said solid particles have a mean diameter of from about 5 μm to about 100 μm, a speed through said hydrocarbon steam-cracking installation of from about 70 m/s to about 480 m/s, and wherein the ratio of said solid particles to gases is from about 0.01% to about 10%, by weight.

4. A method as claimed in claim 3, wherein said solid particles have a mean of from about 5 μm to about 85 μm, a speed through said hydrocarbon steam-cracking installation of from about 130 m/s to about 300 m/s, and wherein the ratio of said solid particles to gases is from about 0.1% to about 8% by weight.

5. A method as claimed in claim 1, wherein the solid particles are introduced into said hydrocarbon steam-cracking installation at a plurality of points.

6. A method as claimed in claim 2, including mixing the solid particles separated from the vector gas in the cyclone with a liquid selected from the group consisting of, water, a hydrocarbon liquid substantially free from pyrolysis heavy aromatic compounds, a fraction of the hydrocarbon feed stock substantially free from pyrolysis heavy aromatic compounds, and combinations thereof, and wherein said step of recycling the particles comprises pumping the mixture of solid particles and the liquid recycled into the hydrocarbon steam-cracking installation.

7. A method as claimed in claim 6, wherein the step of mixing the solid particles separated by the cyclone with a liquid comprises causing the liquid to flow continuously from a source line over a wall situated around and below the particle-arrival zone, thereby forming a wetted wall.

8. A method as claimed in claim 1, wherein the solid particles are substantially spherical metallic or inorganic particles formed by gas spraying.

9. A method as claimed in claim 8, wherein the particles are porous inorganic particles based on silica or alumina.

10. A method as claimed in claim 1, wherein the solid particles are a mixture comprising relatively soft coke catalyzing metallic particles and harder, more erosive particles.

11. A method as claimed in claim 1, including the additional steps of:

allowing a layer of coke of desired thickness to form on the inside walls of the hydrocarbon steam-cracking installation; and maintaining said thickness of said layer of coke by erosion using said solid particles.

* * * * *